United States Patent [19]

Saunders

[11] 4,047,481

[45] Sept. 13, 1977

[54] APPARATUS FOR PRINTING INDICIA ON CORRUGATED BOARD AND THE LIKE

[75] Inventor: Philip G. Saunders, Toledo, Ohio

[73] Assignee: Container Graphics Corporation, Toledo, Ohio

[21] Appl. No.: 662,561

[22] Filed: Mar. 1, 1976

[51] Int. Cl.[2] ..... B41F 27/12

[52] U.S. Cl. ..... 101/376; 101/379

[58] Field of Search ..... 101/376, 379, 471

[56] References Cited

U.S. PATENT DOCUMENTS

| | | | |
|---|---|---|---|
| 2,893,320 | 7/1959 | Jones | 101/379 X |
| 3,128,700 | 4/1964 | Kunetka | 101/379 |
| 3,295,443 | 1/1967 | Devon | 101/376 |
| 3,903,794 | 9/1975 | Grupe | 101/376 |

OTHER PUBLICATIONS

Class 96 schedule, p. 1; & class 101 schedule, p. 2; U.S. Patent Off. manual of class schedules.

*Primary Examiner*—Edward M. Coven

*Assistant Examiner*—A. Heinz

*Attorney, Agent, or Firm*—Allen D. Gutchess, Jr.

[57] ABSTRACT

Apparatus for printing indicia on corrugated board in particular is provided. The apparatus includes a printing plate made of a polymer material which has a number of advantages over conventional printing plate materials. However, because the polymer material is somewhat resilient and exhibits a degree of yieldability, and dimensionally-stable sheet is provided, which is either on the back of the material or molded into the material near the back. The printing plate is adhered to a mounting sheet which is also dimensionally stable and is mounted on a printing plate cylinder. A resilient or compressible layer or pad is affixed to the back of the mounting sheet, between the mounting sheet and the printing cylinder, and is of a size at least equal to that of the printing plate. The pad provides additional compressibility and resiliency to enable the printing plate to effectively print indicia on corrugated board and also raises the printing surfaces of the printing plate farther from the surface of the printing plate cylinder.

7 Claims, 3 Drawing Figures

APPARATUS FOR PRINTING INDICIA ON CORRUGATED BOARD AND THE LIKE

This invention relates to apparatus for printing corrugated board.

Corrugated board, commonly known as corrugated cardboard, is often considered more difficult to print than paper and other sheet material because the corrugated board tends to have a somewhat uneven surface due to the corrugated construction therein and because the corrugated board tends to yield or be deformed if excess pressure is applied during the printing process.

The printing apparatus or assembly according to the invention for printing indicia on corrugated board is made up of several components. One component is a printing plate made of a photo polymer material on which printing surfaces can be readily formed and which print more fully and distinctly on the corrugated board than conventional printing plates. The polymer plate also is less expensive than conventional rubber plates and has a longer life. The ink applied to the printing surfaces on the polymer plate also is substantially entirely released each time it contacts a corrugated board, which again is not true of conventional plates. The polymer printing plate is somewhat resilient and yieldable and, consequently, lacks dimensional stability because of such characteristics. To overcome this and to prevent distortion of the printing surfaces thereon, the polymer plate is supplied with a dimensionally-stable sheet integral with the back thereof or molded within the polymer layer near the back. In a preferred form, this sheet is of a thin Mylar plastic material.

The printing apparatus also includes a mounting sheet, preferably of a polyvinyl chloride plastic material, the thickness of which can be closely controlled and which is also dimensionally stable. The mounting sheet can be mounted on a printing plate cylinder by means of an integral lip formed on one edge of the mounting sheet and by means of special resilient straps affixed in openings near the opposite edge of the mounting sheet.

Of particular importance, the printing assembly includes a resilient layer or pad which is affixed to the back of the mounting sheet and is located between the mounting sheet and the printing plate cylinder. The pad is of a size at least equal to that of the printing plate. The resilient pad is effective to provide compressibility and some additional resiliency for the printing surfaces of the printing plate to accommodate uneven surfaces of corrugated board even more effectively than otherwise. The resilient pad also increases the thickness of the overall assembly and raises the distance the printing surfaces on the printing plate extend above or beyond the surface of the printing plate cylinder. The proper thickness is important for the effective printing of the corrugated board which is passed between the printing plate cylinder and a back-up roll.

With the resilient pad located on the back of the mounting sheet opposite the printing plate, the printing plate can be located directly on the mounting sheet with the dimensionally-stable sheet thereof being contiguous with or at least adjacent to the mounting sheet. With both of these dimensionally-stable sheets thereby close together, the printing plate will not tend to buckle when the mounting sheet is arcuately moved in a direction toward or away from the printing plate as can occur with the resilient pad therebetween.

It is, therefore, a principal object of the invention to provide an improved assembly of printing components for printing indicia on corrugated board.

Another object of the invention is to provide a printing assembly for corrugated board which includes a printing plate having a dimensionally-stable sheet mounted on a mounting sheet, with the mounting sheet being provided with a resilient pad located between the mounting sheet and a printing plate cylinder on which the sheet is mounted.

Other objects and advantages of the invention will be apparent from the following detailed description of a preferred embodiment thereof, reference being made to the accompanying drawings, in which.

Figure 1:
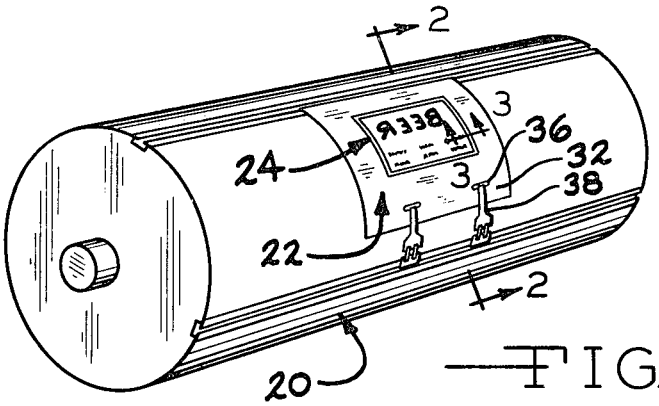
FIG. 1 is a view in perspective of a printing plate cylinder having a mounting member or sheet fastened thereto.
Figure 2:
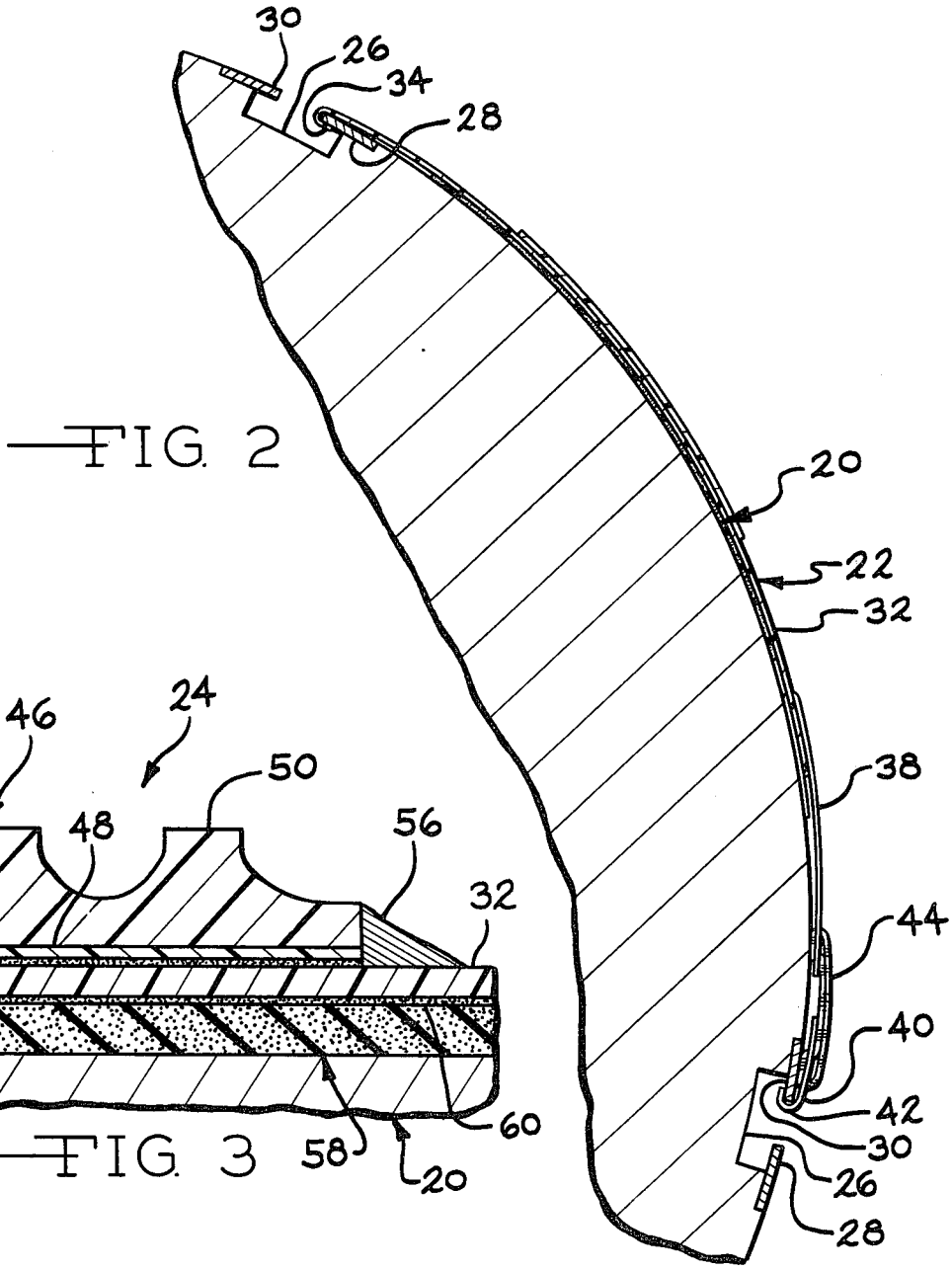
FIG. 2 is an enlarged, fragmentary view in transverse cross section taken along the line 2—2 of FIG. 1.

Referring particularly to FIG. 1, a printing plate cylinder 20 has a printing assembly thereon which includes a mounting member or sheet 22 fastened on the cylinder, with a printing plate 24 mounted on the sheet. These assembled components are used in a rotary printing press to print indicia on sheet material and specifically on corrugated board which is passed between the printing plate cylinder 20 and a back-up roll located thereunder (not shown). One or more inking cylinders or rolls are also associated with the printing plate cylinder 20 to apply ink to the face of the printing plate 24. Typically, the cylinder 20 has several longitudinally-extending channels or grooves 26 having first mounting flanges 28 and second mounting flanges 30 affixed flush to the cylinder with the flanges extending toward one another over portions of the channels 26.

The mounting member or sheet 22 comprises a single sheet 32 of plastic material of a given size and shape. The plastic material can be a general purpose, calendered, rigid, polyvinyl chloride sheeting. Typically, the sheet is 0.030 inch thick with a variation of only $\pm$ 0.001 inch. The sheet also is used in a thickness of 0.050 inch. The sheet 32 usually tends to assume an arcuate configuration even when not mounted on the cylinder 20.

A leading edge of the sheet 32 has a structurally-integral lip 34 which is engaged over the first flange 28. A trailing edge of the mounting sheet 22 has spaced rectangular openings or slots 36 for mounting the sheet on the flange 30 of another one of the channels 26. For this purpose, first portions 38 of mounting straps can be employed which are received in the slots 36 and doubled back. The first portions are connected to second portions 40 having lips 42 received over the edge of the flange 30, with the second portions 40 being connected to the first strap portions 38 by resilient bands 44. Straps of this nature are disclosed more fully in my U.S. Pat. No. 3,934,509 issued on Jan. 27, 1976. Usually two or three of the mounting straps are used to mount the mounting sheets 22 on the cylinder 20, two straps being shown.

Figure 3:
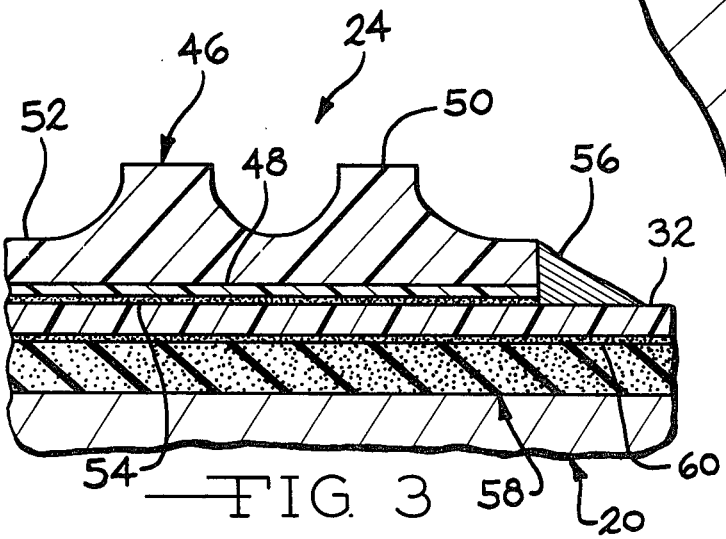
FIG. 3 is a further enlarged view in transverse cross section, taken along the line 3—3 of FIG. 1.

The printing plate 24 is made of photo polymer material which displays some resiliency, typically in the order of fifty durometers on the Shore A scale. Referring to FIG. 3, the plate 24 has a layer 46 of this material and a sheet 48 which is usually located on the back of the layer but can be molded into the layer 46 near the back surface thereof. The layer 46, being somewhat resilient and yieldable, also tends to stretch and be dimensionally unstable. Consequently, the sheet 48, which is dimensionally stable, maintains the necessary dimensional stability of the overall printing plate 24. The sheet 48 can be of a Mylar plastic material, by way of example.

The printing plate 24 has several advantages over conventional rubber printing plates. Printing surfaces can be formed relatively easily on the face of the layer 46 and the printing plate is less expensive than conventional ones. Further, the plate 24 prints more clearly and accurately than conventional rubber ones and appears to have longer life. The photo polymer printing plate also releases substantially all ink during the contact of the printing surfaces with the corrugated board, which is not true of conventional rubber or synthetic rubber plates. In order to form printing surfaces 50 on the face of the layer 46, the layer 46 is subjected to ultraviolet light at those portions where the printing surfaces are to remain. The material is then subjected to caustic solutions and other processes which cause those portions of the layer 46 not treated by the ultraviolet light to be dissolved, forming recesses 52 between the printing surfaces 50.

After the printing surfaces 50 are produced on the face of the printing plate 24, the back surface thereof and, specifically, the back surface of the dimensionally-stable sheet 48, is affixed in the desired position on the mounting sheet 22 by a layer 54 of adhesive. A sealing strip 56 of bituminous caulking material, for example, is then applied around the edges of the printing plate 24 and on the outer, convex surfaces of the mounting sheet 22 to prevent contaminants from entering under the sheet 48 and causing it to separate from the mounting sheet.

In accordance with the invention, a resilient layer or pad 58 is affixed to the back or concave surface of the mounting sheet 22 by a layer of adhesive 60. In a preferred form, the resilient layer or pad 58 is of a closed-cell foam construction which provides resiliency and compressibility. However, it is to be understood that the instant invention is not to be limited to any specific material for this layer. The layer 58 is of a size at least equal to the size of the printing plate 24 and preferably somewhat larger. The resilient layer 50 adds a degree of resiliency for the overall printing assembly and causes it to print more effectively on corrugated materials having nonuniform or wavy surfaces. The layer 58 also serves to place the printing surfaces 50 of the printing plate 24 at a proper distance from the surface of the printing cylinder 20. Thus, it is usually desired that the surfaces 50 be a distance of 0.250 inch from the surface of the printing cylinder 20. With the mounting sheet 22 having a thickness of 0.030 inch and with the thickness of the printing plate 24 being 0.155 inch, a thickness of 0.065 inch for the layer 58 will provide the desired placement for the printing plate surface 50. The thickness of the layer 58 exceeds that of the mounting sheet 22 and preferably is less than that of the printing plate 24.

With the resilient layer 58 being on the back of the mounting sheet 22, rather than between the printing plate 24 and the convex surface of the mounting sheet 22, the dimensionally-stable sheet 48 of the printing plate 24 will be contiguous with or at least adjacent to the surface of the mounting sheet 22. Since the sheets 24 and 48 are both dimensionally stable, this prevents the printing plate 24 from buckling relative to the mounting sheet if the sheet is flattened from its arcuate configuration. Such buckling causes the printing surfaces to assume a wavy configuration which prevents proper printing of the corrugated board. Further, this condition may not even be rectified by re-affixing the printing plate on the mounting sheet.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. Apparatus for printing indicia on corrugated board comprising a printing plate cylinder having at least two mounting flanges thereon, and a printing assembly, said printing assembly consisting of a mounting sheet of dimensionally-stable, solid, calendered, rigid, polyvinyl chloride sheeting having a uniform thickness, said mounting sheet having a structurally integral lip formed on one edge thereof and engaging one of said cylinder flanges, the opposite edge of said mounting sheet having openings therein, mounting straps received in said openings and engaging another of said cylinder flanges, a printing plate comprising a layer of a resilient material with printing surfaces thereon and recesses between the printing surfaces, and a dimensionally-stable sheet affixed to said layer in a location spaced from said printing surfaces and said recesses, an adhesive layer affixing said printing plate to said mounting sheet in a predetermined position, said printing surfaces being on the side of the printing plate opposite said dimensionally-stable sheet, and a resilient and compressible pad affixed to the side of said mounting sheet opposite said printing plate, being of a size at least equal to the size of said printing plate, and also being located between said mounting sheet and said printing plate cylinder.

2. Apparatus according to claim 1 characterized by said dimensionally-stable sheet of said printing plate being on the back of said layer of resilient material and affixed to said mounting sheet by the layer of adhesive material.

3. Apparatus according to claim 1 characterized by said dimensionally-stable sheet being of a thin plastic material.

4. Apparatus according to claim 1 characterized by said resilient pad being mounted on said mounting sheet by an adhesive layer.

5. Apparatus according to claim 1 characterized by said resilient pad being made of a closed-cell foam material.

6. Apparatus for printing indicia on corrugated board comprising a printing plate cylinder having at least two mounting flanges thereon, and a printing assembly, said printing assembly consisting of a mounting sheet of dimensionally-stable plastic material having a uniform thickness, said mounting sheet having a lip on one edge thereof engaging one of said cylinder flanges, the opposite edge of said mounting sheet having openings therein, mounting straps received in said openings and engaging another of said cylinder flanges, a printing plate of a resilient photo polymer material having a dimensionally-stable thin plastic sheet on one side thereof, an adhesive layer affixing said dimensionally-stable sheet to said mounting sheet in a predetermined position, said printing plate having printing surfaces on the side thereof opposite said dimensionally-stable sheet, and a resilient and compressible pad of closed cell foam material affixed to the side of said mounting sheet opposite said printing plate by a layer of adhesive material, being of a size at least equal to the size of said printing plate, being thicker than said mounting sheet, and also being located between said mounting sheet and said printing plate cylinder.

7. Apparatus according to claim 6 characterized by a strip of sealant material located along all edges of said printing plate adjacent said mounting sheet.

* * * * *